US008494665B2

(12) United States Patent
Griffin

(10) Patent No.: US 8,494,665 B2
(45) Date of Patent: Jul. 23, 2013

(54) METHOD FOR PROCESSING BOARD GAME MOVE RECORD INFORMATION

(76) Inventor: John Arthur Griffin, Laguna Woods, CA (US)

( * ) Notice: Subject to any disclaimer, the term of this patent is extended or adjusted under 35 U.S.C. 154(b) by 8 days.

(21) Appl. No.: 13/200,698

(22) Filed: Sep. 29, 2011

(65) Prior Publication Data

US 2013/0085585 A1 Apr. 4, 2013

(51) Int. Cl.
*G06F 19/00* (2011.01)

(52) U.S. Cl.
USPC ..... 700/91; 700/90; 700/92; 705/25; 705/26; 705/28

(58) Field of Classification Search
USPC ..... 700/91, 92; 705/26, 25, 28
See application file for complete search history.

(56) References Cited

U.S. PATENT DOCUMENTS 6,896,618 B2 * 5/2005 Benoy et al. ..... 463/25
8,142,268 B2 * 3/2012 Thomas et al. ..... 463/6
8,317,601 B1 * 11/2012 Luciano, Jr. ..... 463/25
2001/0014619 A1 * 8/2001 Kusuda ..... 463/6
2011/0066518 A1 * 3/2011 Mack et al. ..... 705/26.3
2011/0271208 A1 * 11/2011 Jones et al. ..... 715/753

* cited by examiner

*Primary Examiner* — Pierre Eddy Elisca
*Assistant Examiner* — Shahid Kamal
(74) *Attorney, Agent, or Firm* — Raymond Sun

(57) ABSTRACT

The present invention comprises a method for processing move information obtained from a board game move-recording device in order to produce an accurate record of the moves of the game. In particular, the present invention is intended for use with board games such as chess in which the game pieces move between fixed locations. Further, the present invention is intended for use with a simpler and less expensive class of board game move-recording devices that are capable of detecting the presence or absence of a game piece on any one of the game board's fixed locations, but which are not further capable of determining the identity of the detected piece. The objective of the present invention is to resolve any ambiguities found in the move information produced by those devices and, thereby, enable those devices to produce complete and accurate game records.

12 Claims, 11 Drawing Sheets

*Fig. 4*

400 → Game Record

- 402 → a. linked list of Board Position Records (420)
- 404 → b. linked list of occupancy-change data items
- 406 → c. current move number
- 408 → d. pointer to the current occupancy-change data item
- 410 → e. color indicator of player whose turn it is to move 420 → Board Position Record

- 422 → a. array having one element for each board playing location
- 424 → b. Move Description Record (430) for this position 430 → Move Description Record

- 432 → a. move type indicator
- 434 → b. source (starting) square number
- 436 → c. destination square number

METHOD FOR PROCESSING BOARD GAME MOVE RECORD INFORMATION

PRIOR ART REFERENCES

U.S. PATENT DOCUMENTS

| | | | |
|---|---|---|---|
| 810,899 | January 1906 | Babu | |
| 2,434,066 | January 1948 | Fey | 234-1.5 |
| 3,654,392 | April 1972 | Beinhocker | 179/2 |
| 3,683,363 | August 1972 | Khlebutin | 340/323 |
| 3,843,132 | October 1974 | Ferguson | 273/136 |
| 4,391,447 | July 1983 | Dudley | 273/238 |
| 4,981,300 | January 1991 | Winkler | 273/238 |
| 5,013,047 | May 1991 | Schwab | 273/238 |
| 5,129,654 | July 1992 | Bogner | 273/238 |
| 6,102,397 | August 2000 | Lee | 273/238 |
| 6,168,158 | January 2001 | Bulsink | 273/237 |

FOREIGN PATENT DOCUMENTS

| | | |
|---|---|---|
| DE-2,932,167 | February 1981 | Averdung |
| GB-2,051,589 | January 1981 | Folwell |

STATEMENT REGARDING FEDERALLY SPONSORED RESEARCH

No part of the present invention is associated with or was developed under a federally sponsored research program.

COMPUTER PROGRAM LISTING APPENDIX

A computer program listing appendix submitted on a compact disc (CD-R) is hereby incorporated by reference. The computer program listing provides a full and functioning example of the use of the present invention in the processing of move record information from the game of international chess.

The content of the submitted CD-R is described as follows:

Machine format: IBM-PC

Compatible operating system: Microsoft Windows (version XP or later)

The content of the CD-R comprises a complete "project" within the Microsoft "Visual C# 2010 Express" software development environment. The entire content of the project is included on the CD-R to enable one skilled in the art to view the program listing for the project and to reproduce an executable version of the program represented by the project. To that end, the entire directory structure of the project is presented within the topmost directory named "ChessBdl". That entire directory structure occupies 4,502,215 bytes. The majority of the files within that directory structure are automatically produced by the development environment based on program code entered by the programmer. The files containing program code entered by the programmer have a file extension of ".cs". The names of those files, their size in bytes and their creation dates are listed below:

| File Name | size in bytes | creation date |
|---|---|---|
| Program.cs | 13,086 | Aug. 9, 2011 |
| Form1.cs | 32,208 | Aug. 23, 2011 |

-continued

| File Name | size in bytes | creation date |
|---|---|---|
| Form1.Designer.cs | 100,254 | Aug. 11, 2011 |
| ChessBdComm.cs | 12,390 | Sep. 12, 2011 |
| GameScore.cs | 221,553 | Sep. 12, 2011 |
| MoveList.cs | 17,199 | Mar. 30, 2011 |

Two copies of the CD-R described above have been submitted. The content of the two copies is identical.

BACKGROUND OF THE INVENTION

1. Field of the Invention

The present invention relates to computerized devices that automatically record information concerning the moves that human players make while playing board games. In particular, the present invention comprises a method for further processing such move information in order to create a fully accurate and complete game record.

2. Objectives of the Present Invention

It is well known that a good way for a player to improve his play in a board game such as chess or checkers (draughts) is to record personal games for later analysis. Manual recording of games, however, can be distracting to the player and his opponent, and is prone to errors that can make the game record difficult or impossible to interpret at a later time. For this reason, board game devices have been created that attempt to automatically recognize and record the moves of a game while it is being played. Many types of such devices have been created utilizing a wide range of technologies. To accomplish their task, all such devices must be capable of detecting the presence or absence of a playing piece on any possible board location. Some of the devices, however, are further capable of determining the identity of the particular playing piece at each location, and are hereinafter referred to as piece-identity devices. The aforementioned devices that cannot also determine the identity of each playing piece are hereinafter referred to as presence-only devices.

When prior art devices have been used to record games, such as chess, between two human players, it has primarily been for the purpose of displaying the game moves, as they occur, for the benefit of an audience. This use requires that the moves be accurately detected in real time with no chance for ambiguity. Therefore, piece-identity devices are required for that purpose. Such piece-identity devices can also be used to record casual games for later analysis. However, piece-identity devices are presently complex and expensive and may require manual input from the players and/or connection to external computers and external power outlets. Casual players who simply wish to record games for later personal use are not well served by such devices.

Presence-only devices, in contrast, often have the advantage of lower cost and the convenience of portability that derives from battery-powered operation. Presence-only devices, however, can have difficulty in recognizing exactly which move was made in certain ambiguous cases. A particular example of ambiguity can occur in the game of chess during capture moves. In the game of chess, a playing piece may have the option to choose which of multiple opposing pieces it will capture. A presence-only recording device can detect that the capturing piece has left its original square, but it may not detect any other change in the board position. This can happen when the captured piece is replaced so quickly by the capturing piece that the removal of the captured piece was never detected. As a result, a presence-only recording device cannot specify exactly which piece was captured. The present invention was developed to provide a method by which the ambiguities encountered by presence-only devices can be resolved, so that the cost and convenience advantages of such devices can, thereby, be fully realized.

3. Comparison of Prior Art to the Present Invention

Prior art includes a number of presence-only devices that can record the moves of board games such as checkers and chess. Many such devices were created to play one side of a game against a human opponent, and are offered for sale by companies such as Fidelity Electronics, Novag and Saitek.

Prior art presence-only devices use a number of methods for resolving the ambiguities mentioned above when determining which moves have been made by their human opponents. Some devices use pressure sensitive switches under each board square (U.S. Pat. No. 2,434,066). The human player is required to press down on a piece before it is moved, and then to press down on the piece once again after it is placed on the destination square. Specific examples are the Novag Obsidian, the Saitek Mephisto and a device commonly marketed as the USB Roll-up Chess Board.

Still other presence-only devices require that a permanent magnet be placed into the base of each playing piece. The resulting magnetic field is then detected by sensors placed at each playing location (U.S. Pat. Nos. 3,843,132 & 4,981,300, U.K. Patent GB-2,051,589 & German Patent DE-2,932,167). However, to resolve the aforementioned ambiguities, these devices require the user to execute moves in a strict sequence. A capture move in chess, for example, may require that the captured piece be lifted first, followed by the lifting of the capturing piece, followed by the placement of the capturing piece on the square of the captured piece. An example of a device that requires such sequences is the Novag Citrine.

All of the aforementioned prior art suffers from the primary disadvantage of inconvenience to the human players. Pressing switches and executing strict move sequences is unnatural for many players and distracts them from the game. The method of the present invention improves upon the prior art by using sophisticated post-processing of move information in order to resolve move ambiguities. The human players are, thereby, freed from the requirement to follow strict manual move protocols and can make moves in their individual and varied fashions.

SUMMARY OF THE INVENTION

The present invention comprises a method which, when embodied as a control program in a general purpose digital computer, transforms that computer into a special purpose device for processing board game move information for the purpose of producing an accurate record of the moves of the game. The move information is received from a device that automatically records the moves of a board game such as chess as the game is played by two human players. Further, the present invention is intended for use with a simpler and less expensive class of board game move-recording devices that are capable of detecting the presence or absence of a game piece on any one of the game board's fixed locations, but which are not further capable of determining the identity of the detected piece. The inability of such devices to determine the identity of the piece on a given board location can lead to ambiguities in the move record. The present invention resolves those ambiguities and, thereby, enables complete and accurate game records to be obtained from the output of those move-recording devices.

The method of the present invention resolves such ambiguities by exhaustively evaluating all possibilities at the point of the ambiguity. For each possible move or result at the point of the ambiguity, the method creates an additional copy of the current game path. The method then selects one game path, from the resulting plurality of paths, to be followed to the end of the game. If the game path selected for further processing does not, in fact, represent the path taken in the actual game, then an impossible position or move will very likely be encountered. Upon encountering an impossible position or move, the method discards the current path and returns to the point at which the path was duplicated and selects another path to follow. Processing continues in this manner until a path is successfully followed to the end of the game. The successful path can then be saved as the final game record.

When a game path has been successfully followed to the end of the game, there is, however, still a small possibility that this game path is not the actual path followed by the game. Untested paths may still remain, and the actual game path may be among them. To handle this case, the method of the present invention can be extended to add the capability to attempt to follow all remaining untested paths to the end of the game. In the unlikely, but possible, event that more than one path is thus successfully followed to the end of the game, the method then provides the human operator the option of manually selecting from among the successful paths.

In the preferred embodiment, the method of the present invention will be embodied in a computing device that is external to the move-recording device. The move-recording device will communicate its move information to the external computing device for processing. In another embodiment, the method of the present invention can be embodied in a computing device that is contained within the move-recording device. In either embodiment, the move information can be processed as it is recorded or it can be processed only after a game is completed. In either case, it is likely that all aforementioned ambiguities will not be resolved until move information at or near the end of the game has been processed.

BRIEF DESCRIPTION OF THE DRAWINGS

FIG. 4 shows a preferred format for the game record data structure used for recording game paths.

FIG. 6, however, expands several steps of FIG. 5 to provide more detail of a possible embodiment of the present invention.

DETAILED DESCRIPTION OF THE INVENTION

Figure 1:
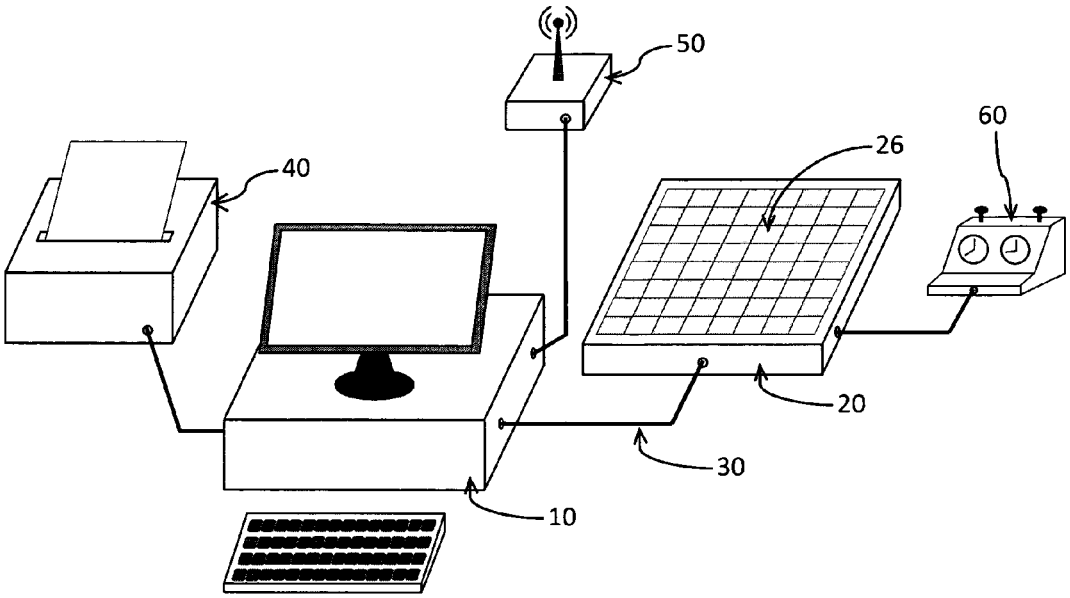
FIG. 1 is a diagram showing a preferred physical environment in which the present invention can be used.

The present invention applies to a large class of board games in which each playing piece is moved from one fixed location or area of the board to another such fixed location or area, and in which each of the playing pieces may be moved several times during the course of a game. A further trait of the aforementioned class of board games is that each game begins with all of the game pieces located on a fixed configuration of playing locations as established by the rules of each game. Examples of games in this class are checkers (draughts) and international chess and regional chess variations such as Shoji (Japanese chess) and Xiangqi (Chinese chess). The present invention is used in conjunction with a class of devices that record information regarding the moves played between human players in such games. Said class of devices is further described as being capable of detecting when a given game board playing location is occupied by a playing piece, but not being further capable of determining the identity of the particular piece on a given location. Such devices are herein referred to as presence-only recording devices.

Presence-only recording devices typically scan all game board playing locations looking for indications that a previously occupied board location is no longer occupied or that a previously unoccupied location is now occupied. Such scans may occur at fixed or variable time intervals or in response to a player action such as pressing a button on a game timer. All occupancy state changes detected during a scan are added to the end of a time-ordered sequence of data items hereinafter referred to as occupancy-change data items. A preferred format for such data items is subsequently described in references to FIG. 3. In most cases, occupancy-change data is easily interpreted as showing a single playing piece leaving a given playing location and arriving on another playing location. In some cases, however, the interpretation is ambiguous. A particular example of ambiguity can occur in the game of chess during capture moves. In the game of chess, a playing piece may have the option to choose which of multiple opposing pieces it will capture. A presence-only recording device can detect that the capturing piece has left its original square, but it may not detect any other change in the board position. This can happen when the captured piece is replaced so quickly by the capturing piece that the removal of the captured piece was never detected. As a result, the occupancy-change data from a presence-only recording device cannot specify exactly which piece was captured. A second type of ambiguity in a chess game can occur during Pawn promotion. When promoted, a Pawn is usually replaced by a Queen. However, there are sometimes reasons to replace the Pawn with a lesser piece such as a Rook, Bishop or Knight. A presence-only device cannot determine which piece was chosen for the promotion.

As previously mentioned, the present invention comprises a method to further process the occupancy-change data items provided by presence-only recording devices in order to resolve the aforementioned ambiguities, and, thereby, realize the full potential of the advantages of the presence-only recording devices.

For clarity, the following description of the present invention will utilize examples from the game of international chess. However, it should be kept in mind that the present invention is applicable to a large class of board games as mentioned above.

Now referring to FIG. 1, a preferred physical embodiment of the present invention is shown. A general purpose digital computer 10 is connected to a presence-only game recording device 20 through a two-way communication channel 30. The method of the present invention is embodied in computer 10 in the form of a controlling program that transforms computer 10 into a device capable of processing the occupancy-change data items received from game recording device 20. Once having processed the occupancy-change data items, computer 10 can output the resulting game summary to a printer 40 and/or transmit the summary through an Internet interface device 50 to one or more external computers and/or save the summary to a file located in the mass storage device of computer 10.

A defining component of game recording device 20 is the game board 26. Game board 26 is typically a planar array of playing locations that is located on, and is readily visible as, the top surface of recording device 20. Game recording device 20 operates by scanning all of its game board playing locations looking for changes in the occupancy of its playing locations. These scans can occur at regular time intervals or can occur at the prompting of an external event such as a player pressing a button on a game timer 60 that is connected to recording device 20. In a preferred embodiment, game recording device 20 is not connected to computer 10 while one or more games between two human players are being recorded by device 20. The connection is made only after the games are completed and the players wish to produce a tangible record of their games. This sequence enables the players to take full advantage of the portability of the recording device 20. It is well recognized that, in another embodiment, the capabilities of computer 10 can be physically located within recording device 20. In that embodiment, the method of the present invention would then be a controlling program within recording device 20, and printer 40 and Internet interface device 50 would connect directly to recording device 20.

Figure 2:
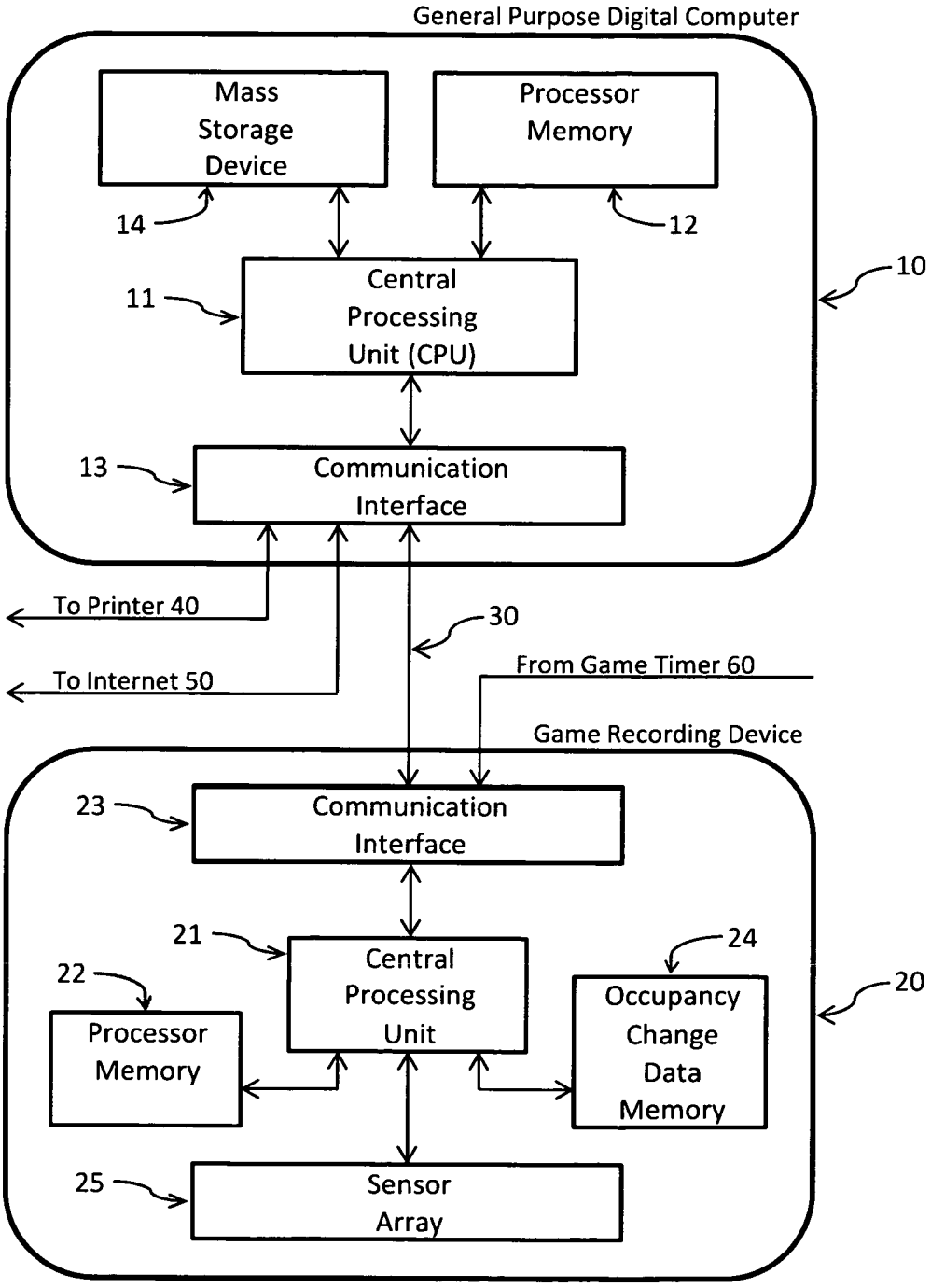
FIG. 2 is a block diagram showing the primary internal components of the primary devices shown in FIG. 1.

Now referring to FIG. 2, a block diagram is provided that shows the primary internal components of the general purpose digital computer 10 and the game recording device 20. The main component of digital computer 10 is the Central Processing Unit (CPU) 11. The purpose of CPU 11 is to follow the instructions of programs that have been loaded from Mass Storage Device 14 and placed into Processor Memory 12. The method of the present invention is such a program. CPU 11, under program control, directs Communications Interface 13 to send messages to and receive messages from external devices such as game recording device 20, printer 40 and Internet interface device 50.

The main internal component of game recording device 20 is the Central Processing Unit (CPU) 21. The purpose of CPU 21 is to follow the instructions of the game recording device control program located in Processor Memory 22. Sensor Array 25 consists of a plurality of sensing devices. Typically one sensing device is located under each playing location of Game Board 26 (FIG. 1). CPU 21 under the direction of its control program regularly checks the state of each sensor in sensor array 25 looking for changes to the occupancy state of each game board playing location. All detected changes are stored, in time sequence order, to occupancy-change data memory 24. After one or more games have been played and their move information stored to memory 24, the game recording device 20 can be connected to digital computer 10 through communication channel 30. CPU 11 will then establish a communication link through communication interfaces 13 and 23 to CPU 21. CPU 11 will then request that CPU 21 transmit, via communication channel 30, the move information stored in occupancy-change data memory 24. CPU 11, under control of the method of the present invention, will then translate the received information into a complete and human-readable record of the games played.

Figure 3:
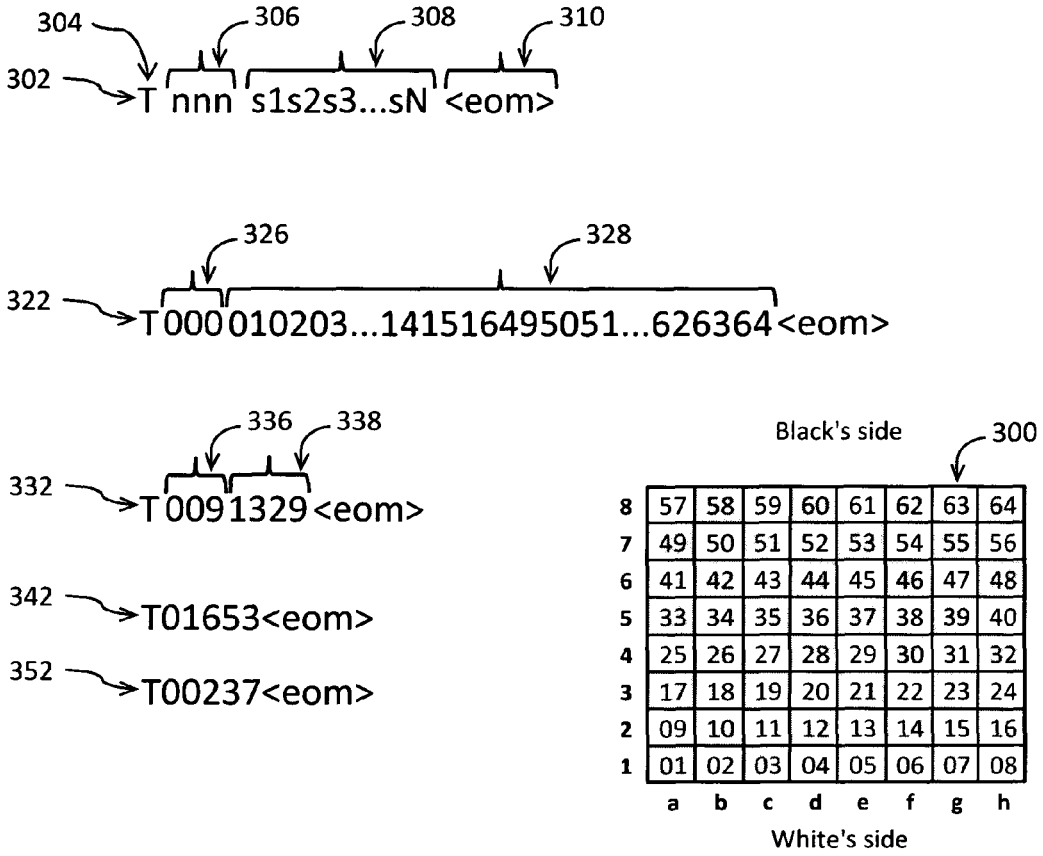
FIG. 3 shows a preferred format for the move information that is produced by a presence-only chess game recording device for subsequent translation by the method of the present invention.

Now referring to FIG. 3, a preferred format is shown for the occupancy-change data items that are developed and stored by a chess game recording device and later translated by the method of the present invention into a finalized record for a game of chess. Character string 302 shows the general format of an occupancy-change data item. String 302 illustrates that an occupancy-change data item consists of three fields (304, 306 and 308) with each field containing one or more human-readable ASCII characters. The three fields are contiguous with no intervening blank characters and are followed immediately by an End-of-Message (eom) character 310. The first field 304 always consists of a single capital letter "T" to indicate the start of an occupancy-change data item and also to indicate the start of the three-character time field 306. Time field 306 consists of three ASCII number characters (here represented by "nnn") giving the number of time units since the previous occupancy-change data item was recorded. Field 308 consists of a string of one or more two-digit ASCII numbers (here represented by s1 through sN) each showing the number of a chess board square that changed state either from occupied to unoccupied or from unoccupied to occupied. As shown in the chess board diagram 300, the numbers s1 through sN would be in the range 01 through 64 to represent any square on the board. The international convention for identifying the rows (ranks) of a chess board by the numbers "1" through "8", and the columns (files) by the letters "a" through "h" is shown at the left and bottom, respectively, of chess board diagram 300. Game boards for games other than chess may well require a different numbering system.

String 322 represents the first occupancy-change data item that would be stored after power is applied to a presence-only chess game recording device in which the game pieces were placed on their starting squares before power was applied. The time value of "000" in field 326 is, by convention, the first time value recorded when power is applied to the game recorder. The time field 326 is then immediately followed by field 328 consisting of thirty-two two-digit numbers in the two ranges 01 to 16 and 49 to 64. Those thirty-two numbers are the square numbers for the chess board squares that are occupied at the start of a game. By convention, all game board squares are initialized as unoccupied by the game recording device immediately after power is applied. Therefore, if all chess pieces are in their starting position when power is first applied, the first scan of the piece sensors by a chess game recorder would show a change in the occupancy state of squares 01 to 16 and squares 49 to 64.

String 332 shows an example of an occupancy-change data item that might be recorded following the first move of a chess game. Field 336 indicates that nine (009) time units elapsed since the previous occupancy-change data item was recorded. In this case, the previous data item was the one recorded at time "000" and shown as string 322. Field 338 indicates that chess board squares 13 and 29 changed occupancy state as a result of this first move. Therefore, this first move represents the Pawn move e2 to e4.

The occupancy-change data items given as strings 342 and 352 show the second move of this chess game and illustrate how a single game move may be recorded using more than one consecutive occupancy-change data items. String 342 shows that sixteen (016) time units after the previous data item was recorded the occupancy state of chess square 53 changed. String 352 shows that two (002) time units later the occupancy state of square 37 changed. This sequence indicates that the Black Pawn on square e7 was lifted and, after a short delay, was placed on square e5.

The preceding descriptions of two Pawn moves illustrates that a simple chess move may be fully described in one occupancy-change data item or that same move may be described by two consecutive occupancy-change data items. If a player can start and end a move between consecutive scans by the recording device then all of the move information will appear in one occupancy-change data item. Otherwise, more than one data item will be recorded to describe the move. An extreme example is the Castling move from the game of chess which requires moving both the King and a Rook. If performed quickly, a Castling move could be recorded in a single occupancy-change data item that contains the numbers of four squares—two which became unoccupied and two which became occupied. If performed more slowly, that same move could require the recording of up to four consecutive occupancy-change data items. Determining how the time-ordered sequence of occupancy-change data items should be grouped to describe individual moves is highly dependent on the type of game being recorded, and may require considerable game-specific case analysis. Since such analysis is game-specific, it is not claimed as a capability within the method of the present invention. In fact, it may, at times, be possible for the game-specific analysis to find more than one seemingly valid way to interpret a particular sequence of occupancy-change data items. The method of the present invention handles such ambiguous situations by allowing all seemingly valid interpretations to be considered during the search for the move sequence that was actually played. How this is done is described in the following paragraphs and in more detail in references to the flowcharts of FIGS. 5 through 8.

The method used by the present invention to process the sometimes ambiguous data from presence-only game recording devices is analogous to finding a path through a maze from the entry point (the initial game position) to the exit (the final game position). Each path in this hypothetical maze leads either to the exit or to a dead end (an impossible move or position). Each move in the game is analogous to a turning point in the maze. Most such turning points are unambiguous and offer only one direction for movement. Other turning points, however, require a choice between two or more directions. The previous example of an ambiguous capture in the game of chess is analogous to such a turning point. The method of the present invention will choose one of the available directions. This choice can be made randomly, or, in a preferred embodiment, by using game-specific knowledge to select a likely direction. Once the choice is made, the method leaves a "marker" at the decision point and proceeds through the maze while "laying down a string". The "string" will record the entire path taken since the marker was placed. In the event that a dead end is subsequently reached, the path is retraced to the most recent marker and an untried direction is chosen. If an untried direction is not available, the path is retraced to the next most recent marker and the process is repeated. By following this procedure in an iterative manner, the exit will eventually be reached.

In order to perform the steps described above in the maze analogy, the method of the present invention must keep track of sufficient information concerning each game path followed. The method satisfies this requirement by creating a separate game record data structure for each game path. The terms "game record" and "game path" will be used interchangeably in the following description.

Now referring to FIG. 4, a detailed description of a preferred embodiment of the game record data structure for the game of international chess is presented. A Game Record 400 for the game of chess is composed of five parts. The first part is a linked list 402 of Board Position Records 420. The linked list 402 will contain one Board Position Record 420 for each move recorded in the particular game path associated with this Game Record. A Board Position Record 420 has a multi-part structure of its own that will be described below. The second part of Game Record 400 is a linked list 404 of the time-ordered occupancy-change data items that were received from the board game move recording device. Occupancy-change data Items were described above in detail in references to FIG. 3. The complete set of occupancy-change data items received from the game recording device is recorded in linked list 404 of each Game Record 400. While that may seem to be redundant, it should be noted that each game path may require that the sequence of occupancy-change data items be divided and assigned to individual moves in a manner that is unique to that game path. The third part of a Game Record 400 is the current move number 406. The current move number 406 indicates the most recent move recorded in a Game Record 400. In the event that a Game Record is selected to be followed "further into the maze", the current move number 406 indicates the game move at which such further processing should begin. The fourth part of a Game Record 400 is the pointer 408 to the current occupancy-change data Item for this Game Record. Once again, in the event that a Game Record is selected to be followed "further into the maze", pointer 408 indicates which occupancy-change data item will be the next such data item to be processed. The fifth, and final, part of Game Record 400 is the color indicator 410 giving the color of the game player whose turn it is to move next.

The Board Position Record 420 is composed of two parts. The first part is an array 422 containing one element for each playing position on the game board. Each such array element contains an identifier for the game piece (if any) that occupies the corresponding playing position. The second part of Board Position Record 420 is a Move Description Record 430 that describes the move that was made from the position corresponding to the Board Position Record 420.

A Move Description Record 430 is further comprised of three parts. The first part is the move type indicator 432 which describes the type of the current move. For chess, the move types would be: non-capturing, capturing, King side castling and Queen side castling. The second part of a Move Description Record 430 is the source square number 434 which gives the starting square for non-capturing and capturing moves. The third part of a Move Description Record 430 is the destination square number 436 which gives the destination square for non-capturing and capturing moves.

The method of the present invention will now be formally described by references to flowcharts. The description will first be given in a general overview format using references to the flowchart of FIG. 5. The invention will then be described again in a more detailed embodiment using references to the flowchart of FIGS. 6A through 6D.

Figure 5:
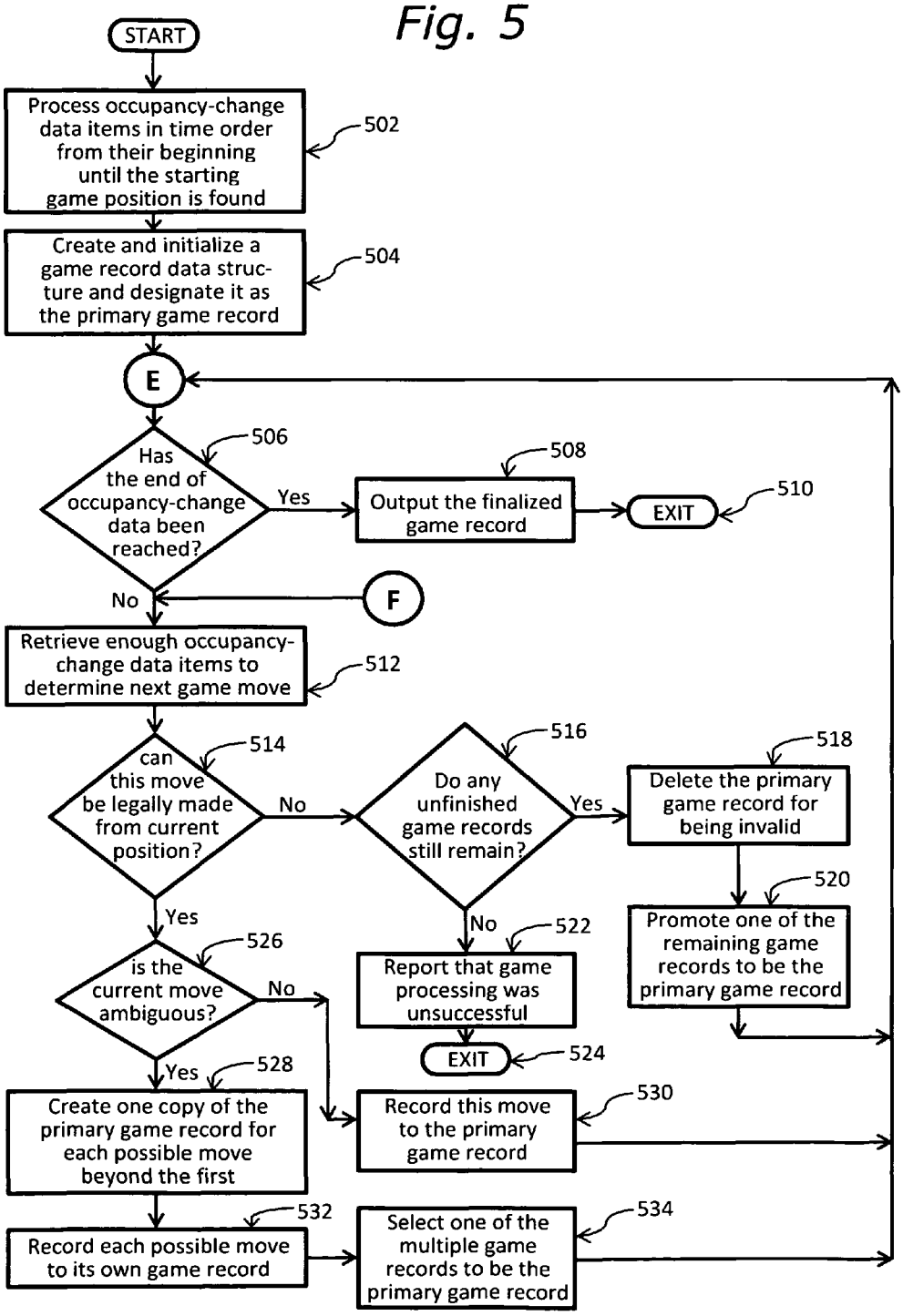
FIG. 5 is a flow diagram that shows the method of the present invention in graphical format.

Now referring to FIG. 5, the method of the present invention begins by reading the occupancy-change data items in their time-ordered sequence starting with the first such data item. The game board playing locations are marked, according to those data items, as occupied or unoccupied, and this continues until the starting position of the game is found 502. Since occupancy-change data does not provide the identity of the playing pieces, the method of the present invention relies on finding the starting position in order to establish the initial position and identity of each piece. If the user of the game recording device places the game pieces in their starting position before applying power to the device, then the starting position will be found in the very first occupancy-change data item. However, if the user first applies power and then places the playing pieces, several occupancy-change data items may need to be processed before the starting position is established.

Once the starting position has been found, the method creates and initializes the first instance of a game record data structure 400 (see references to FIG. 4) that will contain the game record as it is being developed 504. This initial game record is then designated as the primary game record to distinguish it from other game records that may subsequently be created to follow other possible game paths.

The method next begins the processing of individual game moves. This is done by analyzing the occupancy-change data items starting with the first such data item after the starting position is established. If, during the analysis of occupancy-change data items, the end of such data items is encountered 506, then the game record is finalized and output to the user 508 and the method terminates 510. It may often be necessary to examine more than one occupancy-change data item to determine a complete game move 512. For example, in the game of chess, a capture may occur by first lifting the capturing piece from its board square, then lifting the captured piece from its square, and then placing the capturing piece on the square of the captured piece. Such a sequence could result in three separate occupancy-change data items. However, that same sequence could also result in fewer data items depending on the speed at which the player executed the sequence and the frequency at which the move-recording device scanned the game board for changes. To handle such variations, the method of the present invention must be augmented by game-specific case analysis and knowledge of the rules of the particular game to which it is being applied.

Once the game-specific case analysis has consolidated one or more occupancy-change data items into a complete move, the method then determines, by calling on additional game-specific analysis routines, if that move can actually be made from the current game position 514. In chess, for example, if the moving piece is a Knight and yet that piece has moved to a board square that that Knight cannot reach then we have encountered an illegal move or position. In response to such an illegality, the method proceeds to step 516 in order to abandon the current game path and try another. If, however, the move can be made, it is then tested to see if it is ambiguous 526. As previously described, presence-only recording devices for the game of chess can produce ambiguities for certain capture moves and Pawn promotions. The method of the present invention performs the test for ambiguity by, once again, calling on the use of game-specific analysis routines. If the current move is not ambiguous, the method stores that move directly to the primary game record without further processing 530. It then returns to step 506 to continue analyzing subsequent moves. If the move is ambiguous, the method creates one additional copy of the current game record for each possible move or result beyond the first such move or result 528, and then records each one of the plurality of move possibilities to its own individual game record 532. The method, thereby, allows for the eventual following of all possible game paths until the correct path is recognized. The method then selects one game record, from the resulting plurality of game records, to be designated as the primary game record 534 and control returns to step 506 to continue move processing. Processed move results will henceforth be recorded to the designated primary game record until the end of the game is reached or until a subsequent contradiction or ambiguous move results in the selection and/or creation of yet a different primary game record.

If the game record selected as the primary does not, in fact, represent the actual path taken in the game, then an impossible position or move will very likely be encountered at step 514. Upon encountering an impossible position or move, the method determines if the current primary game record is the only game record 516. In the unlikely event that it is the only game record, the user is informed that game record processing was unsuccessful 522 and the method terminates 524.

Otherwise, the method discards the current primary game record 518. It then returns to the point in the game when the just-discarded game record was chosen as the primary and selects another game record to be the primary 520. Control then returns to step 506 to continue move processing. Processing continues in this manner until a game record is successfully followed to the end of the game and output at step 508, or until it is determined that no successful game path exists and that result is reported at step 522.

In the interest of additional clarity the method of FIG. 5 is shown again in more detail in FIG. 6. The correspondences between the two figures are highlighted by the use of the same step numbers in both figures. When a step in FIG. 5 is expanded to multiple steps in FIG. 6, the expansion is indicated by appending, to the original step number, capital letters starting at "A".

Figure 6A:
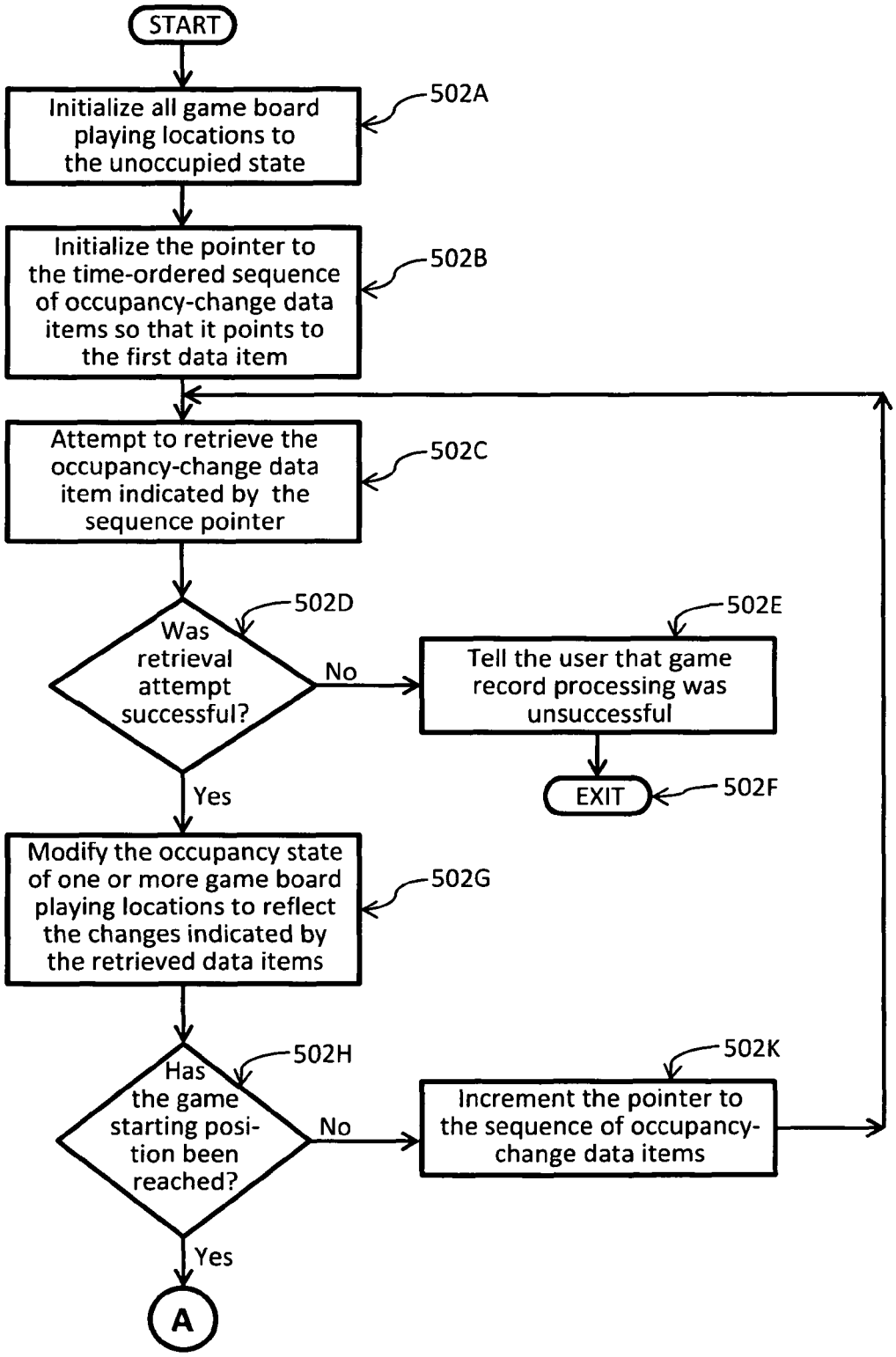
FIG. 6 is also a flow diagram that shows the method of the present invention in graphical format.

Now referring to FIG. 6A, the method of the present invention, in a more detailed exposition, begins by creating a data structure that contains the identity of the playing piece on each playing location of the game board, and initializing that data structure to show no game pieces present 502A. The method then initializes a sequence pointer that points to the first occupancy-change data item in the time-ordered sequence of such items 502B. The method then attempts to retrieve the occupancy-change data item pointed to by the current value in that sequence pointer 502C. It is possible that this retrieval attempt could fail due to encountering the end of the occupancy-change data items. This possibility is tested in step 502D. If the end of data items is encountered at this early stage, the user is informed that game record processing has failed 502E, and the method terminates 502F. If the retrieval attempt was successful, the data structure of step 502A is modified to reflect the retrieved occupancy-change data 502G. The method then tests to see if the game starting position has been reached 502H. If no, the occupancy-change data pointer is incremented 502K, and control returns to step 502C to retrieve the next data item. Steps 502A through 502K, as just described for FIG. 6A, constitute a more detailed exposition of step 502 of FIG. 5.

Figure 6B:
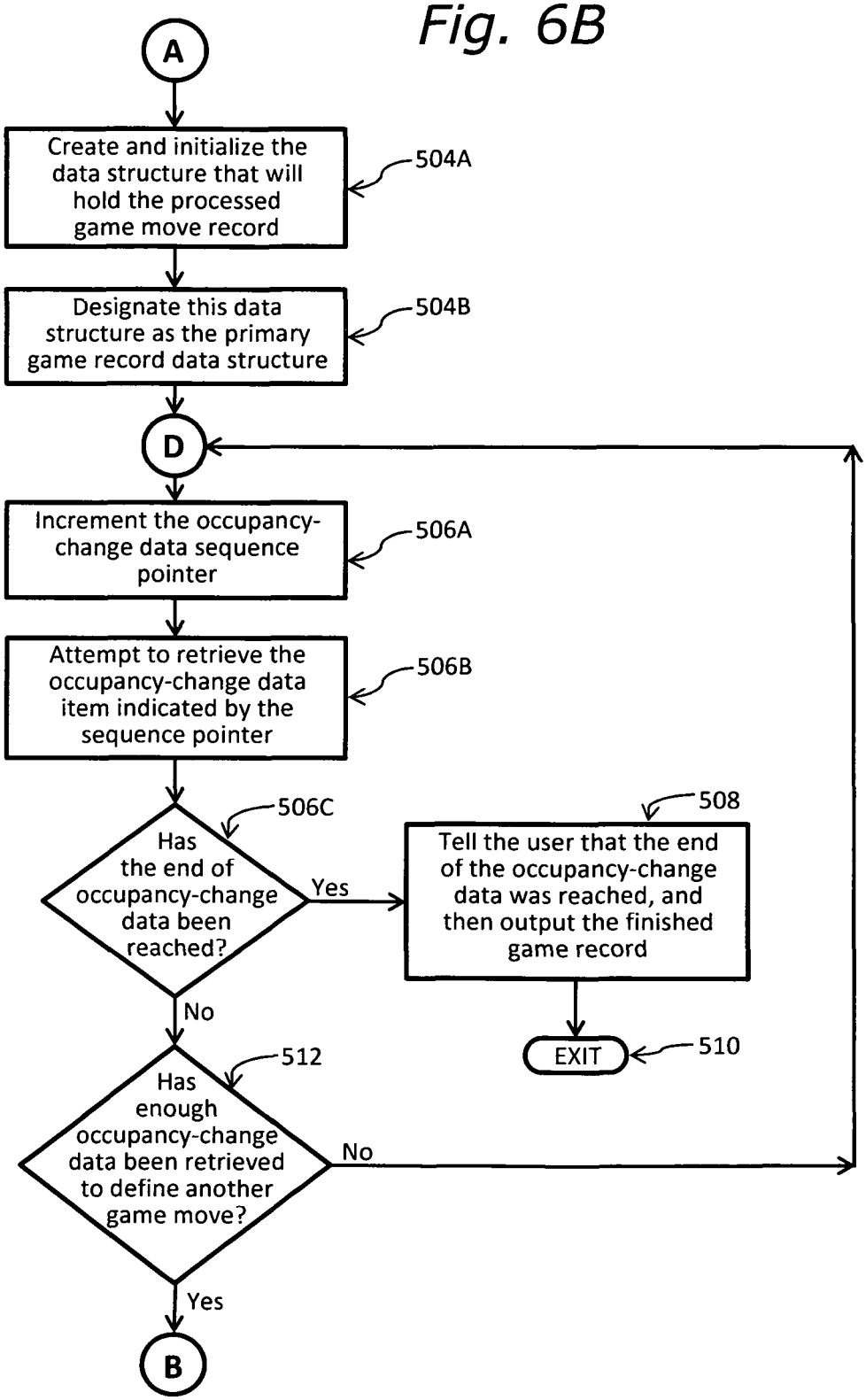

Now referring to FIG. 6B, if the game starting position has been reached, the method performs the following steps: Create and initialize the game record data structure (as described in FIG. 4) that will receive move information as it is subsequently processed 504A. Designate this data structure as the current primary game record data structure 504B. Increment the occupancy-change data sequence pointer 506A, and attempt to retrieve the next data item 506B. The method then tests to see if the retrieval attempt was successful 506C. If no, the user is informed that the end of game data has been encountered and the finished game record is output to the user 508. The method then terminates 510. If the retrieval was successful, the method calls on game-specific analysis routines to determine if enough occupancy-change data items have been retrieved to describe another complete game move 512. If enough data items have not yet been retrieved, control proceeds back to step 506A. Steps 504A through 512, as just described for FIG. 6B, constitute a more detailed exposition of steps 504 through 512 of FIG. 5.

Figure 6C:
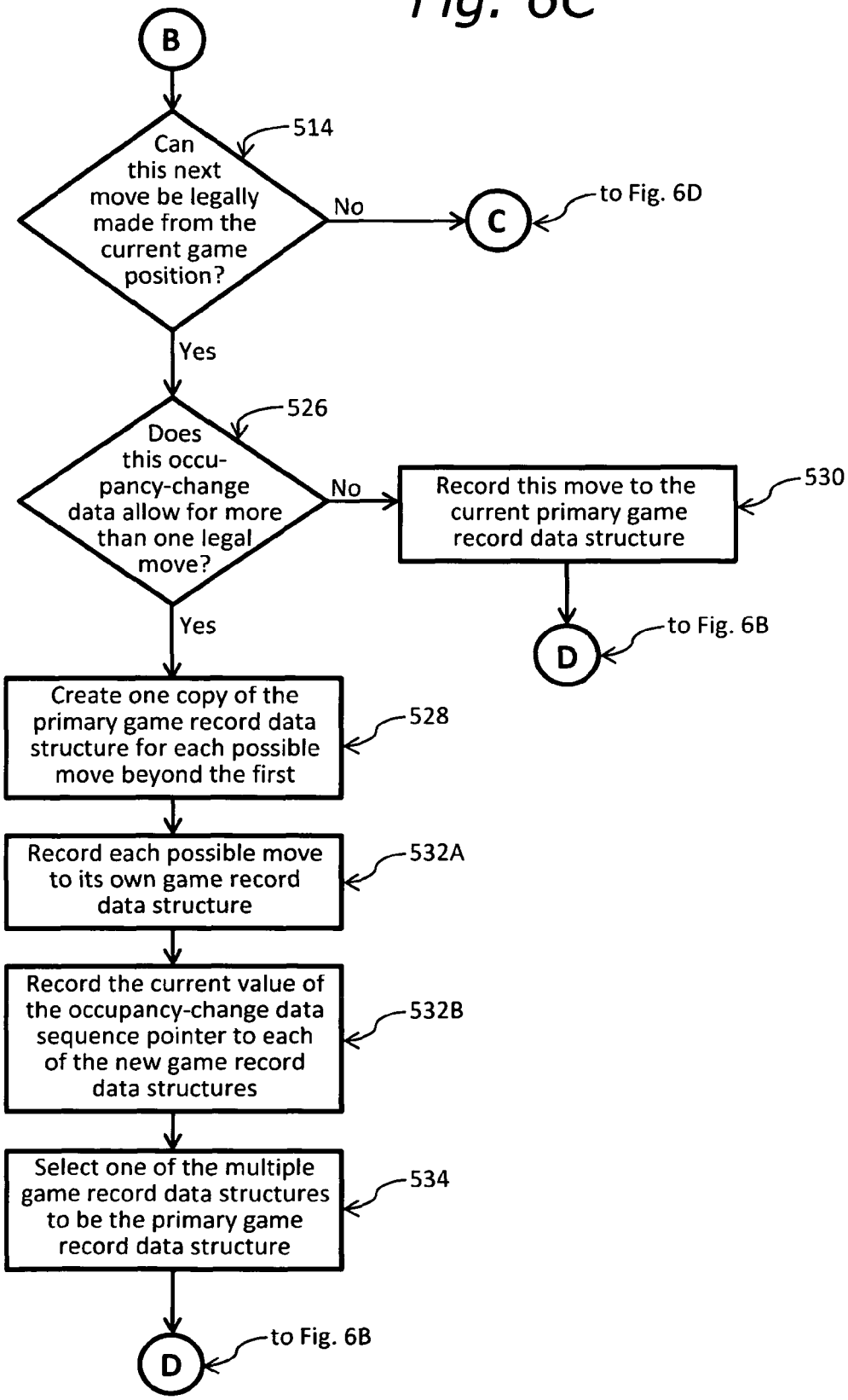

Now referring to FIG. 6C, if enough occupancy-change data items have been retrieved to fully describe the next game move, the method performs the following steps: Determine if that game move can legally be made from the current position 514. As stated in the description of FIG. 5, the method of the present invention makes this determination by calling on the use of game-specific analysis routines. If the move cannot be legally made, proceed to step 516 of FIG. 6D to attempt to follow a different game path. Otherwise, determine if the current move result is ambiguous and could represent more than one legal move 526. Once again, a determination of ambiguity requires the use of game-specific analysis routines. If the move is not ambiguous, record the move to the current primary game record 530, and proceed back to step 506A. If the move is ambiguous, create one copy of the current primary game record for each possible move beyond the first move 528. Record each possible move to its own game record data structure 532A. Record the current value of the occupancy-change data item sequence pointer to each of the new game record data structures 532B. Select one of the multiple game record data structures to be the primary game record 534. Proceed back to step 506A. Steps 514 through 534, as just described for FIG. 6C, constitute a more detailed exposition of step 514 and steps 526 through 534 of FIG. 5.

Figure 6D:
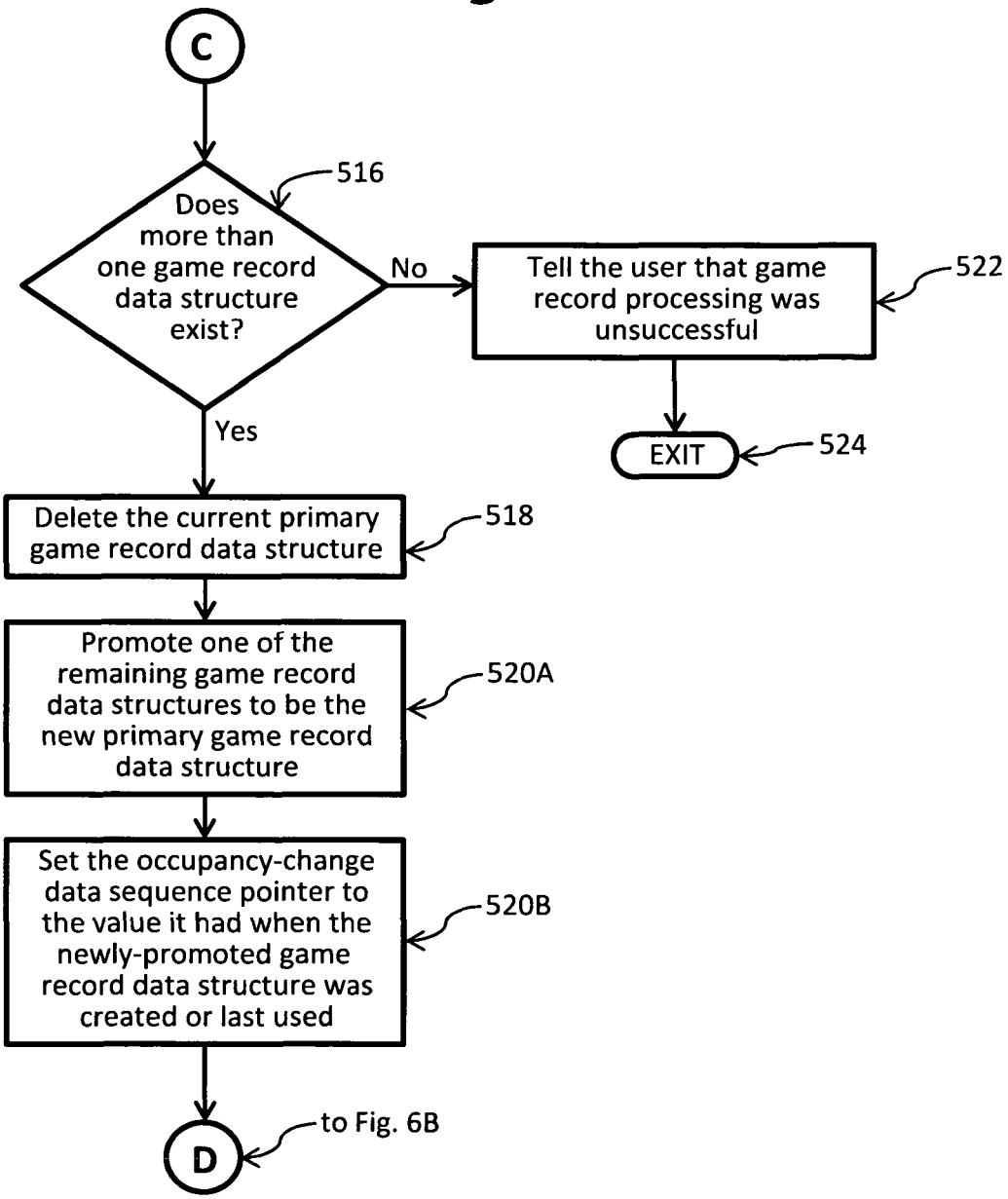

Now referring to FIG. 6D, the method will arrive at step 516 if the current move cannot be legally made in the current position. In that event, the method performs the following steps: Determine if more than one game record data structure currently exists 516. If no, then the only remaining valid game path has failed to result in a legal game. Tell the user that game record processing has been unsuccessful 522, and terminate the method 524. If more than one game record data structure does exist, delete the current primary data structure since it has resulted in an invalid game path 518, and promote one of the remaining game record data structures to be the new primary game record 520A. Set the occupancy-change data sequence pointer to the value stored to the newly promoted data structure when that data structure was created or last used 520B. Proceed back to step 506A. Steps 516 through 524, as just described for FIG. 6D, constitute a more detailed exposition of steps 516 through 524 of FIG. 5.

When the method of the present invention successfully follows its primary game record to the end of a game, there is a possibility that one or more game records other than the primary game record may still remain. It is also possible that one or more of these remaining records can also be successfully followed to the end of the game. For this reason, a preferred embodiment of the present invention will include an extension to the method given in FIG. 5. That extension (shown in FIG. 7) will attempt to follow all remaining game records to the end of the game. If one or more of said remaining game records is successfully followed to the end of the game, then the extended method will further provide the user the opportunity to choose one game record from the plurality of successful game records.

Figure 7:
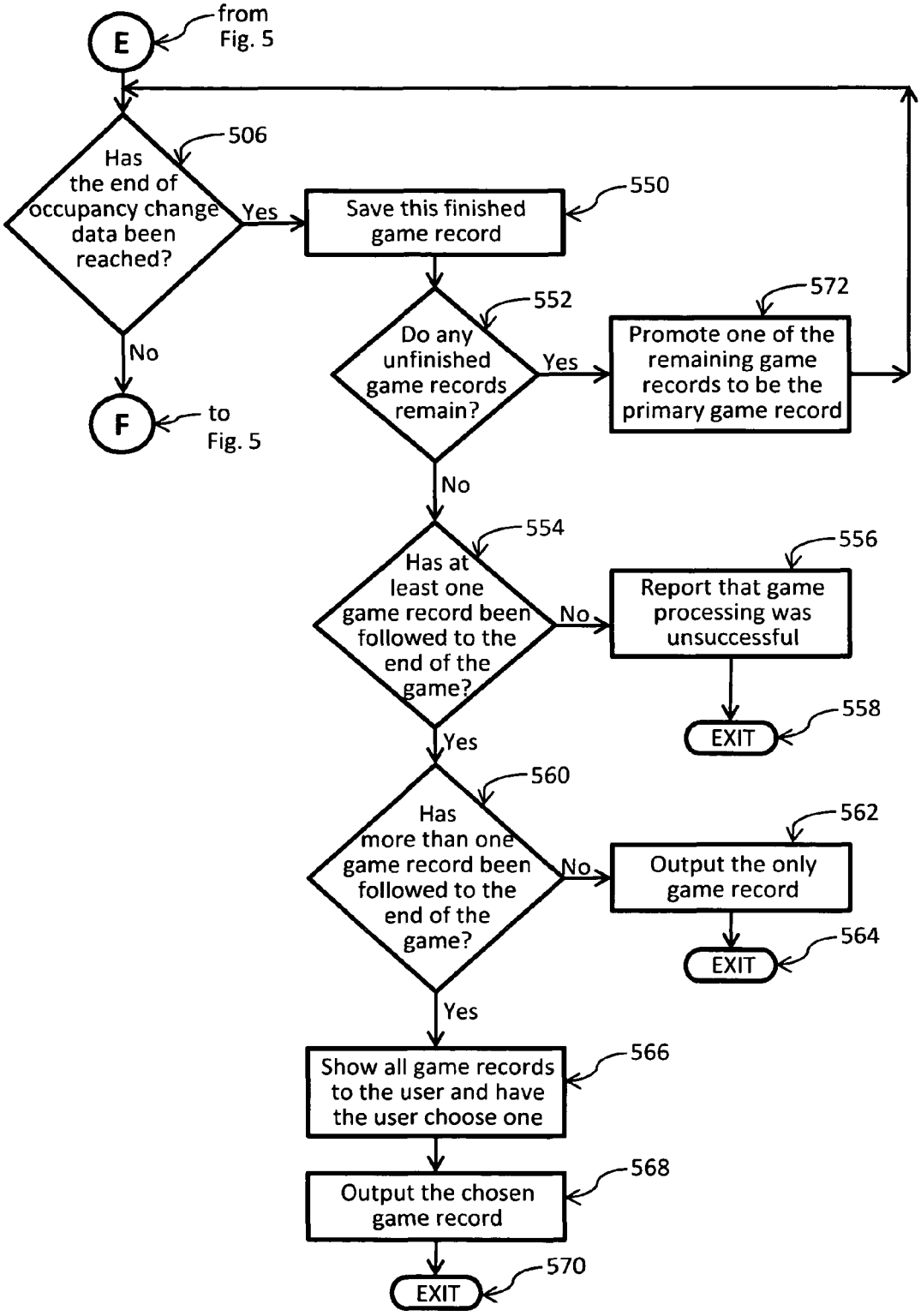
FIG. 7 is a flow diagram that shows how the method of the present invention can be extended to handle the case in which more than one valid game path is found.

Now referring to FIG. 7, an extension of the flow diagram of FIG. 5 is presented to show how the method of the present invention can be extended to handle the case in which more than one valid game path is found. This extension is accomplished by eliminating steps 508 and 510 of FIG. 5 and replacing them with steps 550 through 572 of FIG. 7. Also steps 522 and 524 of FIG. 5 are replaced by an arrow directing control to step 554 of FIG. 7. After this extension, the extended method proceeds as follows: If the end of occupancy-change data has been encountered 506, the extended method saves the current game record 550. The extended method then determines if any game records still remain that have not yet been followed to the end of the game 552. If yes, one of the remaining game records is promoted to be the new primary game record, and the pointer to the occupancy-change data is set to the value that pointer had when this newly promoted game record was created or was last used 572. The procedure for selecting the next game record to be promoted is of little importance since all remaining game paths will eventually be followed. The extended method then proceeds back to step 506. However, if step 552 determines that no unfinished game records still remain, the extended method then determines if at least one game record has been successfully followed to the end of the game 554. If no, the user is informed that game processing was unsuccessful 556, and the extended method terminates 558. If yes, then the extended method determines if more than one game record has been successfully followed to the end of the game 560. If no, then the extended method outputs the one successful game record 562, and terminates 564. However, if there is more than one successful game record, the extended method shows all such game records to the user and accepts the user's choice of game record 566. The extended method then outputs the selected game record 568 and terminates 570. The game records that are shown to the user for selection at step 566 can be presented in any of several game-specific formats. For example, a chess game can be presented as a conventional two-column chess score sheet using algebraic chess notation and showing the moves for the white pieces in the left column and the moves for the black pieces in the right column. At any point in the game at which the user is asked to make a choice, additional columns could be added to the score sheet to indicate the options at that point. To further aid the user in selecting the actual game path followed, a preferred embodiment could also present a pictorial diagram showing the resulting positions of the playing pieces in response to the selection, by the user, of any move on the aforementioned score sheet. The game records that are ultimately output at steps 562 and 568 can be printed in the form of game-specific score sheets and/or saved in any appropriate computer file format for later use. A file format known as Portable Game Notation is widely used in chess. Similar standardized file formats are used for other board games.

Figure 8:
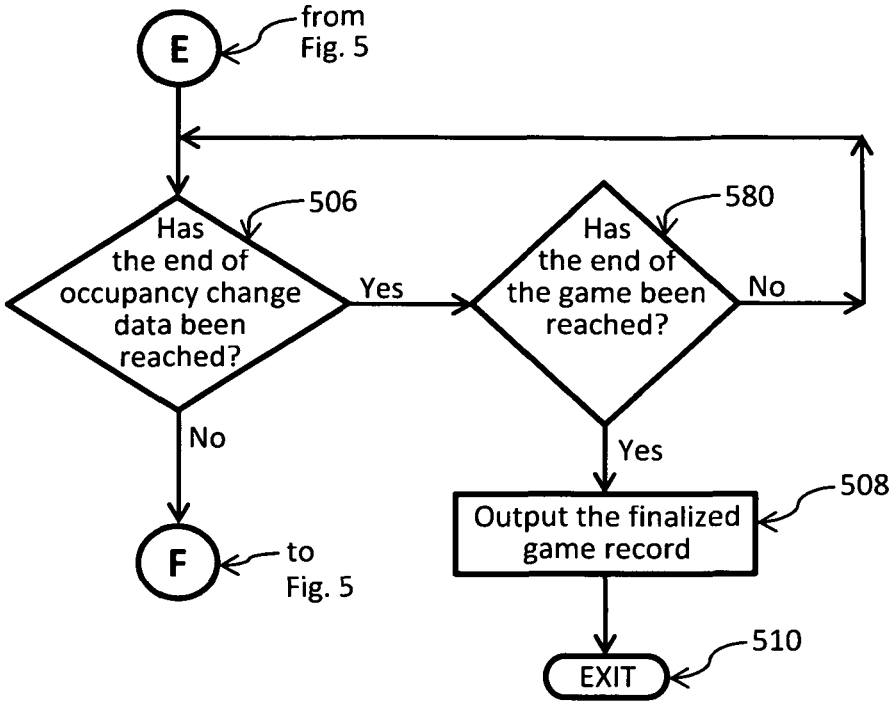
FIG. 8 is a flow diagram that shows how the method of the present invention can be modified to process move information as that information is generated, as opposed to waiting until the game is finished in order to begin processing.

Now referring to FIG. 8, a modification of the flow diagram of FIG. 5 is presented to show how the method of the present invention can be modified to process move information as that information is generated, as opposed to waiting until the game is finished in order to begin processing. This modification is accomplished by inserting step 580 of FIG. 8 between steps 506 and 508 of FIG. 5. Step 580 simply determines if the end of the game has been reached. If no, control proceeds back to step 506 to await the arrival of the next occupancy-change data item. Otherwise, the finalized game record is output 508 and the method terminates 510. The modification given in FIG. 8 requires that it be possible to determine when a game has ended by some method other than simply coming to the end of the occupancy-change data. One possibility is that one of the players will push a button on the game recording device to indicate the end of the game, and that indication will be added to the sequence of occupancy-change data items in the form of a unique end-of-game flag.

It should be noted that the extension shown in FIG. 7 and the modification shown in FIG. 8 can both be applied to the method of FIG. 5 simultaneously.

The many features and advantages of the present invention are apparent from the detailed specification, and thus, it is intended by the appended claims to cover all such features and advantages which fall within the spirit and scope of the invention. The foregoing description is intended to be illustrative of the invention, and is not intended to contain or imply limitations thereupon. Although numerous modifications and variations will occur to those skilled in the art, it is not desired to limit the invention to the exact method and operation illustrated and described, and accordingly, all suitable modifications and equivalents may be resorted to, falling within the scope of the present invention.

The invention claimed is:

1. A board game move-recording system, comprising a game board with game pieces, and a board game move-recording device and a move record analysis device associated therewith, the move recording system having:

means for recording the moves of the game in which said move information is in the form of a time-ordered sequence of occupancy-change data items indicating which game board playing locations have changed state from being occupied to being unoccupied or from being unoccupied to being occupied, but in which said occupancy-change data items do not further indicate the identity of the game piece occupying each game board playing location;

means for creating a primary game record;

means for updating the primary game record as game pieces are moved to and from playing locations;

means for creating a plurality of game records when an ambiguous move is encountered, with each of the plurality of game records based on each possible move that can represent the ambiguous move;

means for eliminating game records if the subsequent moves indicate that the possible moves for such game records were not the actual moves played.

2. A method for processing board game move information obtained from a board game move-recording device, for the purpose of creating a full and unambiguous record of the moves of the game; in which said move information is in the form of a time-ordered sequence of occupancy-change data items indicating which game board playing locations have changed state from being occupied to being unoccupied or from being unoccupied to being occupied, but in which said occupancy-change data items do not further indicate the identity of the game piece occupying each game board playing location; said method comprising the following steps:

i. providing a game board with game pieces, and a board game move-recording device associated therewith;

ii. arranging the game pieces on the game board in a starting arrangement;

iii. creating and initializing a data structure to contain the game record as it is processed and designating said data structure as the primary game record;

iv. based on the move information obtained from the move-recording device, updating the move information in the primary game record by performing the applicable one of the following three steps:

a. when an illegal move is encountered, eliminating the primary game record, and selecting another of the existing game records as the primary game record;

b. when an ambiguous move is encountered, creating one additional game record for each possible move, beyond the first such move that can represent the ambiguous move, recording each possible move to its own game record, and then selecting one of the plurality of game records as the primary game record;

c. when a legal and unambiguous move is encountered, adding that move to the primary game record; and v. repeating the following steps until an end-of-game indicator is received from the move-recording device or the last game record is eliminated:

based on the move information obtained from the move-recording device, updating the move information in the primary game record by performing the applicable one of the following three steps:

a. when an illegal move is encountered, eliminating the primary game record, and selecting another of the existing game records as the primary game record;

b. when an ambiguous move is encountered, creating one additional game record for each possible move, beyond the first such move that can represent the ambiguous move, recording each possible move to its own game record, and then selecting one of the plurality of game records as the primary game record;

c. when a legal and unambiguous move is encountered, adding that move to the primary game record.

3. The method of claim 2, further including outputting a final game record when an end-of-game indicator for the game is encountered.

4. The method of claim 2, further including outputting an error message if all game records have been eliminated.

5. The method of claim 2, wherein steps (iv) and (v) include calling a game-specific analysis method in order to retrieve enough additional occupancy-change data items to construct the next game move.

6. The method of claim 5, wherein the game-specific analysis method further determines if the next move from the current game position is a legal move.

7. The method of claim 5, wherein the game-specific analysis method further determines if the next move from the current position is an ambiguous move.

8. The method of claim 2, wherein between steps (ii) and (iii), playing the moves of a game until an ending position is reached.

9. The method of claim 2, wherein the occupancy-change data is processed as that data is generated.

10. The method of claim 3, further including outputting multiple final game records if more than one game record survives to the end of the move data for the game.

11. The method of claim 10, further including prompting the human operator to choose one of the multiple final game records.

12. The method of claim 11, further including outputting the game record chosen by the human operator.

* * * * *